US007883382B2

(12) United States Patent
Howard et al.

(10) Patent No.: US 7,883,382 B2
(45) Date of Patent: Feb. 8, 2011

(54) GROUNDING APPARATUS AND GROUNDING SYSTEM INCLUDING THE SAME

(76) Inventors: Hal D. Howard, 8003 Stinson Hartis Rd., Indian Trail, NC (US) 28079; Philip R. Sluder, 4153 Marley Ct., Rock Hill, SC (US) 29732; David R. Sommer, 2501 Blarney Stone La., Bloomington, IL (US) 61704

( * ) Notice: Subject to any disclaimer, the term of this patent is extended or adjusted under 35 U.S.C. 154(b) by 0 days.

(21) Appl. No.: 12/368,439

(22) Filed: Feb. 10, 2009

(65) Prior Publication Data

US 2010/0203775 A1 Aug. 12, 2010

(51) Int. Cl.
*H01R 4/36* (2006.01)

(52) U.S. Cl. ..... 439/810

(58) Field of Classification Search ..... 439/793, 439/810, 814

See application file for complete search history.

(56) References Cited

U.S. PATENT DOCUMENTS

| | | | | |
|---|---|---|---|---|
| 7,128,619 | B1 * | 10/2006 | Muench, Jr. | 439/810 |
| 7,438,607 | B2 * | 10/2008 | Fong | 439/810 |
| 7,604,516 | B2 * | 10/2009 | Adunka et al. | 439/709 |
| 2005/0202732 | A1 | 9/2005 | Rizzo et al. | |

OTHER PUBLICATIONS

Thomas & Betts Corporation, "Meets the New Code Requirements of 2008 NEC® Section 250.94 for Intersystem Bonding Termination!", Blackburn® Intersystem Bonding Termination Meter Box Ground Clamp, 2007, 2 pp.

ILSCO, "Intersystem Grounding & Bonding Termination Connectors from ILSCO", http://www.ilsco.com/newweb/News.nsf/DocLookup/55BE8F147EEE707B052574CC0070..., Jan. 9, 2009, 1 p.

ILSCO, "GBT Intersystem GRD Tap", http://ebusiness.ilsco.com/webapp/wcs/stores/servlet/CategoryDisplay?storeID=10001&lang..., Jan. 9, 2009, 1 p.

Erico International Corporation, "Intersystem Bonding Termination", https://www.erico.com/productPrint.asp?productid=2606, 2009, 2 pp.

Globalspec, "Machine Design: Grounding Bar", http://productsearch.machinedesign.com/FeaturedProducts/Detail/PowerEdgeProducts/Grou..., 1999-2009, 1 p.

Lewis, J., "Our 10th month! Electrical code issues and answers.", Electrical Currents, Code guidance from the Department of Labor and Industries, Office of the Chief Electrical Inspector, Oct. 1998, 2 pp.

Thomas Publishing Company, "Ground Clamp meets 2008 NEC Section 250.94 requirements", ThomasNet® Industrial NewsRoom®, Dec. 24, 2007, 5 pp.

POWEREDGEPRODUCTS.COM, "GND Terminator® GND Terminator Jr®", http://poweredgeproducts.com/main.asp, Jan. 9, 2009, 3 pp.

* cited by examiner

*Primary Examiner*—Khiem Nguyen

(57) ABSTRACT

A grounding system includes a mounting surface, a first ground conductor including first and second ends, a plurality of second ground conductors, and a grounding apparatus. The grounding apparatus includes an elongated conductive member having a first end including an open jaw lug structured to receive and electrically and mechanically engage a portion of the first ground conductor extending transverse to the elongated conductive member, an opposite second end, and an intermediate portion disposed between the first end and the opposite second end. The intermediate portion includes a plurality of lugs. Each of the plurality of lugs is structured to receive and electrically and mechanically engage an end portion of a corresponding one of the second ground conductors. The intermediate portion further includes a plurality of mounting apertures. Each of a plurality of fasteners mounts the intermediate portion to the mounting surface at a corresponding one of the mounting apertures.

12 Claims, 2 Drawing Sheets

GROUNDING APPARATUS AND GROUNDING SYSTEM INCLUDING THE SAME

BACKGROUND

1. Field

The disclosed concept pertains generally to grounding apparatus and, more particularly, to grounding apparatus for a ground conductor and a plurality of other conductors. The disclosed concept also pertains to grounding systems including a grounding apparatus.

2. Background Information

It is known to employ a neutral bar to provide a common point for termination of a plurality of neutral conductors and one ground conductor in a panelboard or load center. Each of a plurality of screw terminals electrically and mechanically engages one end of a corresponding neutral or ground conductor.

It is known to employ a ground bar to provide a common point for termination of a plurality (e.g., six) of grounding and bonding conductors. Each of a plurality of screw terminals electrically and mechanically engages one end of a corresponding wire or ground conductor.

The 2008 National Electric Code (NEC) Section 250.94 provides the requirements for intersystem bonding termination. Under NEC 250.94, intersystem bonding and grounding connectors are to be provided external to enclosures at the service equipment and at the disconnecting mechanisms for any additional buildings or structures. Such an intersystem bonding termination device does not interfere with opening a service or metering equipment enclosure. Also, the intersystem bonding termination device has the capacity for connection of not less than three intersystem bonding conductors. NEC 250.94 covers, for example, bonding telephone, cable television (CATV) and satellite to a home's grounding system.

One proposal to address the requirements of NEC 250.94 provides a kit that clamps on a meter socket box. However, the kit damages the paint on the meter socket box and needs sealant to prevent the box from rusting. Also, since meter socket boxes come in many different sizes, the installer has to stock multiple different kit sizes.

Another proposal provides a lay-in intersystem grounding and bonding termination connector. The connector accommodates a grounding electrode conductor and four bonding taps and purports to offer fast, simple installation on the ground electrode conductor below a meter or panel without mounting. The structure of the connector prevents any mounting. The lay-in feature eliminates the need to cut or splice into an existing grounding electrode. The multiple bonding taps terminate up to four communication systems. Stainless steel screws provide corrosion resistance and serrations in the conductor wire way cut oxidation.

There is room for improvement in grounding apparatus.

There is also room for improvement in grounding systems employing a grounding apparatus.

SUMMARY

These needs and others are met by embodiments of the disclosed concept.

In accordance with one aspect of the disclosed concept, a grounding apparatus comprises: an elongated conductive member comprising: a first end including an open jaw lug structured to receive and electrically and mechanically engage a portion of a ground conductor extending transverse to the elongated conductive member; an opposite second end; and an intermediate portion disposed between the first end and the opposite second end, wherein the intermediate portion includes a plurality of lugs, wherein each of the plurality of lugs is structured to receive and electrically and mechanically engage an end portion of a corresponding conductor, and wherein the intermediate portion further includes a plurality of mounting apertures.

As another aspect of the disclosed concept, a grounding system comprises: a mounting surface; a first ground conductor including a first end and a second end; a plurality of second ground conductors; and a grounding apparatus comprising: an elongated conductive member comprising: a first end including an open jaw lug structured to receive and electrically and mechanically engage a portion of the first ground conductor extending transverse to the elongated conductive member, the portion of the first ground conductor being different than the first and second ends thereof, an opposite second end, and an intermediate portion disposed between the first end and the opposite second end of the elongated conductive member, wherein the intermediate portion includes a plurality of lugs, wherein each of the plurality of lugs is structured to receive and electrically and mechanically engage an end portion of a corresponding one of the second ground conductors, wherein the intermediate portion further includes a plurality of mounting apertures, and wherein each of a plurality of fasteners mounts the intermediate portion to the mounting surface at a corresponding one of the mounting apertures.

The intermediate portion may be a ground bar including a first one of the plurality of mounting apertures, the plurality of lugs, and a second one of the plurality of mounting apertures disposed along the elongated conductive member.

The second one of the plurality of mounting apertures may be disposed at the opposite second end of the intermediate portion.

The open jaw lug may include a first threaded opening receiving a first threaded screw lug; each of the plurality of lugs may include a second threaded opening receiving a second threaded screw lug; and the elongated conductive member may have a first thickness at about each of the plurality of mounting apertures, a second thickness at the intermediate portion, and a third thickness at the open jaw lug, the third thickness being greater than the second thickness, the second thickness being greater than the first thickness.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

The disclosed concept is described in association with a grounding apparatus, which meets the requirements of 2008

NEC Article 250.94, although the disclosed concept is applicable to a wide range of grounding apparatus.

Figure 1:
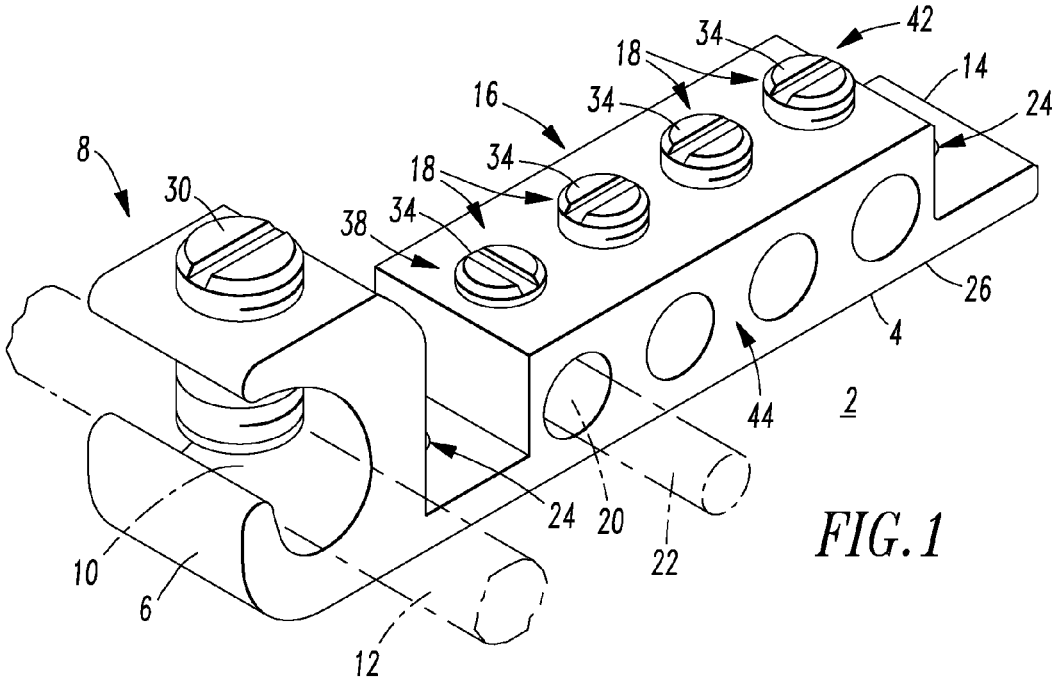
FIG. 1 is an isometric view of a grounding apparatus in accordance with embodiments of the disclosed concept.
Figure 2:
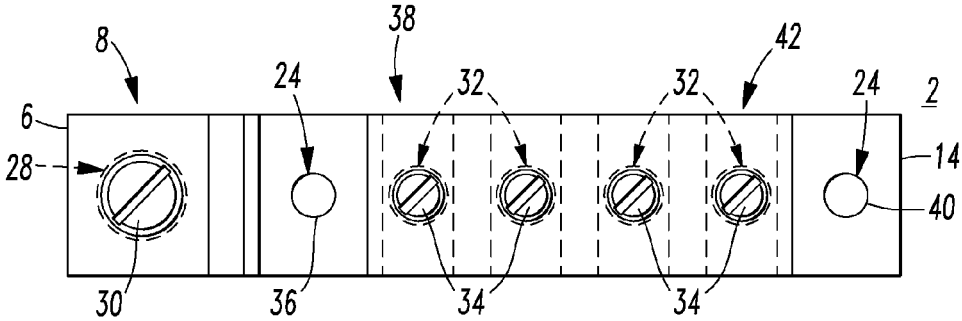
FIG. 2 is a plan view of the grounding apparatus of FIG. 1.
Figure 3:
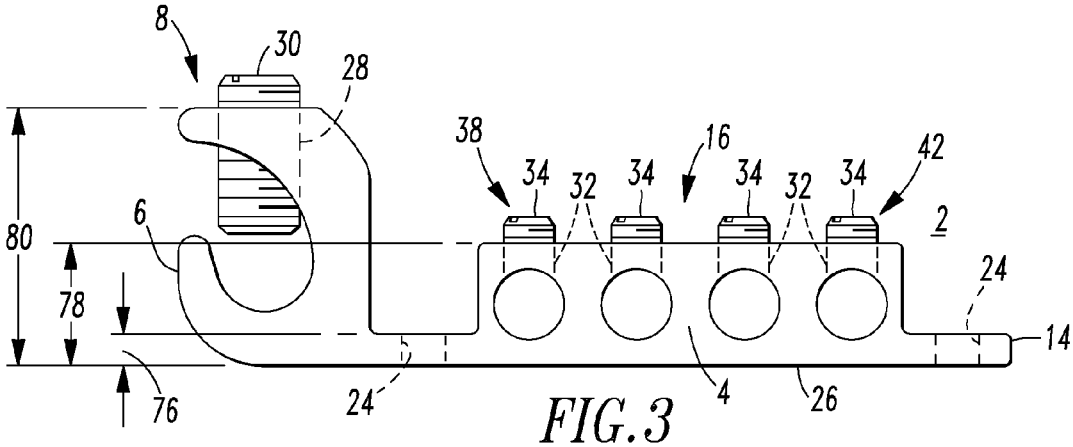
FIG. 3 is a vertical elevation view of the grounding apparatus of FIG. 1.

Referring to FIGS. 1-3, a grounding apparatus 2, such as the example lay-in intersystem grounding and bonding termination connector, is shown. The grounding apparatus 2 includes an elongated conductive member 4, which has a first end 6 with an open jaw lug 8 structured to receive and electrically and mechanically engage a portion 10 of a ground conductor 12 (shown in phantom line drawing in FIG. 1) extending transverse to the elongated conductive member 4. The elongated conductive member 4 also has an opposite second end 14, and an intermediate portion 16 disposed between the first end 6 and the opposite second end 14. The intermediate portion 16 includes a plurality of lugs 18, each of which is structured to receive and electrically and mechanically engage an end portion 20 of a corresponding conductor 22 (as shown in phantom line drawing in FIG. 1 in connection with lug 38). The intermediate portion 16 further includes a plurality of mounting apertures 24.

The elongated conductive member 4 includes a planar surface 26. The mounting apertures 24 are disposed through the planar surface 26. The open jaw lug 8 includes a first threaded opening 28 receiving a first threaded screw lug 30, and each of the plurality of lugs 18 includes a second threaded opening 32 receiving a second threaded screw lug 34. Each of the plurality of lugs 18 is structured to receive the end portion 20 of the corresponding conductor 22 (as shown in phantom line drawing in FIG. 1 in connection with lug 38), in order that the corresponding conductor 22 extends transverse to the elongated conductive member 4.

A first mounting aperture 36 of the plurality of mounting apertures 24 is disposed between the open jaw lug 8 and a first lug 38 of the plurality of lugs 18. A second mounting aperture 40 of the plurality of mounting apertures 24 is disposed at the opposite second end 14 of the elongated conductive member 4 and is next to another lug 42 of the plurality of lugs 18.

The ground conductor 12 (shown in phantom line drawing in FIG. 1) extends transverse to the elongated conductive member 4 in a first direction and also transverse to the elongated conductive member 4 in an opposite second direction, in order that the ground conductor 12 is continuous, with no joint, at the grounding apparatus 2.

The intermediate portion 16 is a ground bar 44 including the two example mounting apertures 36,40 and the plurality of lugs 18 disposed along the elongated conductive member 4. Although two mounting apertures 36,40 and four lugs 18 are shown, any suitable counts of mounting apertures and lugs can be employed.

Figure 4:
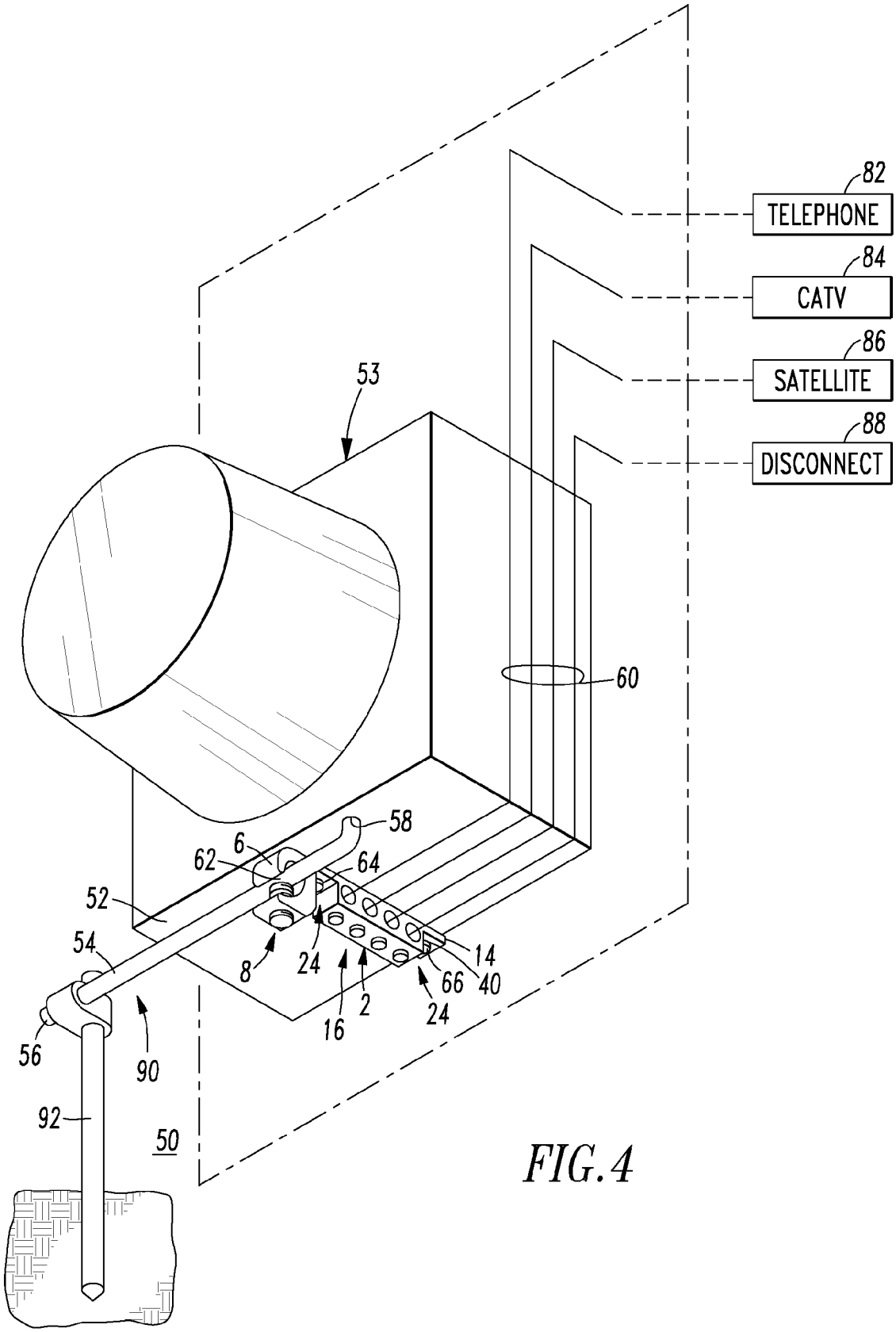
FIG. 4 is an isometric view of a system including a grounding apparatus, a grounding electrode conductor and an enclosure having a mounting surface in accordance with other embodiments of the disclosed concept.

FIG. 4 shows an example grounding system 50 including a mounting surface 52 of an enclosure 53, a first ground conductor 54 including a first end 56 and an opposite second end 58, a plurality of second ground conductors 60, and the grounding apparatus 2 of FIGS. 1-3. A portion 62 of the first ground conductor 54 that is engaged by the open jaw lug 8 is different than the first and second ends 56,58 thereof. Each of a plurality of fasteners 64,66 mounts the intermediate portion 16 of the grounding apparatus 2 to the mounting surface 52 at a corresponding one of the mounting apertures 24. The second mounting aperture 40 is disposed at the opposite second end 14 of the intermediate portion 16.

Referring again to FIG. 3, the elongated conductive member 4 has a first thickness 76 above the planar surface 26 at about each of the plurality of mounting apertures 24, a second thickness 78 at the intermediate portion 16, and a third thickness 80 at the open jaw lug 8. The third thickness 80 is greater than the second thickness 78, which is greater than the first thickness 76.

Example 1

The grounding apparatus 2 is structured to mount, for example and without limitation, on an enclosure (e.g., without limitation, a meter base; enclosure 53 of FIG. 4), a building wall, or an enclosure back board or back pan. When used in combination with the open jaw lug 8, the two mounting apertures 36,40 of the grounding apparatus 2 allow the apparatus to be mounted to an exterior wall on new or existing construction. The grounding apparatus 2 can also be used as part of a control panel in which it is mounted to a back panel (e.g., without limitation, wood; metal) inside an enclosure. Alternatively, the grounding apparatus 2 can be mounted to a bracket, if needed, to ensure a secure connection.

Example 2

The open jaw lug 8 of the grounding apparatus 2 is coupled to a new or existing ground conductor, such as 54 of FIG. 4. Then, the grounding apparatus 2 is coupled to a suitable mounting surface, such as 52, by using suitable fasteners 64,66 (e.g., screws and/or anchors).

Example 3

The example grounding apparatus 2 meets the requirements of 2008 NEC Article 250.94 where a central point of termination is employed to connect and bond all systems of a facility. The grounding apparatus 2 ensures a consistent path to ground and makes certain that all grounds are the same potential. Otherwise, each of the various systems in a facility has their own separate grounding electrode and, in essence, is a separate system. As a result, the separate systems could have a different resistance to ground due to the lack of commonality. Under 2008 NEC Article 250.94 with the example grounding apparatus 2, the separate systems (e.g., without limitation, telephone 82; cable television (CATV) 84; satellite 86; disconnect 88) all have the same grounding point and the same potential.

Example 4

The grounding electrode conductor 90 of FIG. 4 originates in the building service entrance (e.g., where the electric meter connects). As is conventional, the grounding electrode conductor 90 is electrically connected to the service entrance equipment and then is suitably routed to ground (e.g., via a driven grounding electrode 92). The grounding apparatus 2 can be electrically connected to the grounding electrode conductor 90 anywhere along that conductor 90. As an important aspect of the disclosed concept, the open jaw lug 8 allows the grounding electrode conductor 90 to be continuous, with no joints, as is required by the 2008 NEC. The open jaw lug 8 allows the electrical connection anywhere along the grounding electrode conductor 90 on both new or existing systems without disconnection of that conductor 90.

Example 5

The versatile grounding apparatus 2 saves time for the contractor, provides a safe and reliable termination, and meets the 2008 NEC requirements.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A grounding system comprising:

a mounting surface;

a first ground conductor including a first end and a second end;

a plurality of second ground conductors; and a grounding apparatus comprising:

an elongated conductive member comprising:

a first end including an open jaw lug structured to receive and electrically and mechanically engage a portion of said first ground conductor extending transverse to said elongated conductive member, said portion of said first ground conductor being different than the first and second ends thereof, an opposite second end, and an intermediate portion disposed between the first end and the opposite second end of said elongated conductive member, wherein said intermediate portion includes a plurality of lugs, wherein each of said plurality of lugs is structured to receive and electrically and mechanically engage an end portion of a corresponding one of said second ground conductors, wherein said intermediate portion further includes a plurality of mounting apertures, and wherein each of a plurality of fasteners mounts said intermediate portion to said mounting surface at a corresponding one of said mounting apertures.

2. The grounding system of claim 1 wherein said elongated conductive member further comprises a planar surface; and wherein said mounting apertures are disposed through said planar surface.

3. The grounding system of claim 2 wherein said planar surface is structured to be mounted on said mounting surface; and wherein said mounting surface is one of an exterior wall, an exterior of an enclosure, a meter base, a control panel, a back panel of an enclosure, and a bracket.

4. The grounding system of claim 1 wherein each of said plurality of lugs is structured to receive the end portion of the corresponding conductor, in order that said corresponding conductor extends transverse to said elongated conductive member.

5. The grounding system of claim 1 wherein one of said plurality of mounting apertures is disposed between said open jaw lug and one of said plurality of lugs.

6. The grounding system of claim 1 wherein one of said plurality of mounting apertures is disposed at the opposite second end of said elongated conductive member.

7. The grounding system of claim 1 wherein said first ground conductor extends transverse to said elongated conductive member in a first direction and also transverse to said elongated conductive member in an opposite second direction, in order that said first ground conductor is continuous, with no joint, at said grounding apparatus.

8. The grounding system of claim 1 wherein a first one of said plurality of mounting apertures is disposed next to one of said plurality of lugs; and wherein a second one of said plurality of mounting apertures is disposed next to another one of said plurality of lugs.

9. The grounding system of claim 1 wherein said intermediate portion is a ground bar including said plurality of lugs.

10. The grounding system of claim 1 wherein said intermediate portion is a ground bar including a first one of said plurality of mounting apertures, said plurality of lugs, and a second one of said plurality of mounting apertures disposed along said elongated conductive member.

11. The grounding system of claim 10 wherein the second one of said plurality of mounting apertures is disposed at the opposite second end of said intermediate portion.

12. The grounding system of claim 11 wherein said open jaw lug includes a first threaded opening receiving a first threaded screw lug; wherein each of said plurality of lugs includes a second threaded opening receiving a second threaded screw lug; and wherein said elongated conductive member has a first thickness at about each of said plurality of mounting apertures, a second thickness at said intermediate portion, and a third thickness at said open jaw lug, said third thickness being greater than said second thickness, said second thickness being greater than said first thickness.

* * * * *